US008408288B2

(12) United States Patent
Havinga

(10) Patent No.: US 8,408,288 B2
(45) Date of Patent: Apr. 2, 2013

(54) SYSTEM FOR CONDUCTING JOINTED PIPE AND COILED TUBING OPERATIONS

(75) Inventor: Richard D. Havinga, Okotoks (CA)

(73) Assignee: Xtreme Drilling and Coil Services Corp., Calgary, Alberta (CA)

( * ) Notice: Subject to any disclaimer, the term of this patent is extended or adjusted under 35 U.S.C. 154(b) by 0 days.

(21) Appl. No.: 11/369,634

(22) Filed: Mar. 7, 2006

(65) Prior Publication Data

US 2007/0209791 A1 Sep. 13, 2007

(51) Int. Cl.
*E21B 19/22* (2006.01)

(52) U.S. Cl. ..... 166/77.2; 166/77.51; 166/77.1; 175/89

(58) Field of Classification Search ..... 166/77.2, 166/77.51, 85.1, 76.1, 384; 175/89, 113
See application file for complete search history.

(56) References Cited

U.S. PATENT DOCUMENTS

| | | | | |
|---|---|---|---|---|
| 4,265,304 | A | 5/1981 | Baugh | |
| 4,291,762 | A | 9/1981 | Gudgel | |
| 5,439,066 | A | 8/1995 | Gipson | |
| 5,505,565 | A * | 4/1996 | Canales | 405/303 |
| 5,823,267 | A * | 10/1998 | Burge et al. | 166/385 |
| 5,839,514 | A | 11/1998 | Gipson | |
| 6,003,598 | A | 12/1999 | Andreychuk | |
| 6,273,188 | B1 | 8/2001 | McCafferty et al. | |
| 6,408,955 | B2 * | 6/2002 | Gipson | 175/57 |
| 6,609,565 | B1 | 8/2003 | Andreychuk et al. | |
| 6,868,902 | B1 * | 3/2005 | Roodenburg et al. | 166/77.2 |
| 6,932,553 | B1 * | 8/2005 | Roodenburg et al. | 414/22.51 |
| 6,973,979 | B2 * | 12/2005 | Carriere et al. | 175/203 |
| 7,077,209 | B2 | 7/2006 | McCulloch et al. | |
| 2006/0289171 | A1 * | 12/2006 | Wood et al. | 166/380 |

* cited by examiner

*Primary Examiner* — Brad Harcourt

(74) *Attorney, Agent, or Firm* — Bushman & Associates, P.C.

(57) ABSTRACT

A system for conducting earth borehole operations comprising a first support; a mast attached to the first support, a top drive carried by the mast and longitudinally movable thereallong, a second support, a skid carried by the second support, a CT injector carried by the skid, the skid being movable from the first support to the second support and a reel of CT for supplying CT to the CT injector.

109 Claims, 12 Drawing Sheets

SYSTEM FOR CONDUCTING JOINTED PIPE AND COILED TUBING OPERATIONS

BACKGROUND OF THE INVENTION

1. Field of the Invention

The present invention relates to a system for performing earth borehole operations and, more particularly, to a hybrid system for conducting both jointed pipe and coiled tubing (CT) operations.

2. Description of Prior Art

The use of coiled tubing (CT) technology in oil and gas drilling and servicing has become more and more common in the last few years. In CT technology, a continuous pipe wound on a spool is straightened and injected into a well using a CT injector. CT technology can be used for both drilling and servicing, e.g., workovers.

The advantages offered by the use of CT technology, including economy of time and cost are well known. As compared with jointed-pipe technology wherein typically 30-45 foot straight sections of pipe are threadedly connected one section at a time while drilling the wellbore, CT technology allows the continuous deployment of pipe while drilling the well, significantly reducing the frequency with which such drilling must be suspended to allow additional sections of pipe to be connected. This results in less connection time, and as a result, an efficiency of both cost and time.

However, the adoption of CT technology in drilling has been less widespread than originally anticipated as a result of certain problems inherent in using CT in a drilling application. For example, because CT tends to be less robust than jointed-pipe for surface-level drilling, it is often necessary to drill a surface hole using jointed-pipe, cement casing into the surface hole, and then switch over to CT drilling. Additionally, when difficult formations such as gravel are encountered down-hole, it may be necessary to switch from CT drilling to jointed-pipe drilling until drilling through the formation is complete, and then switch back to CT drilling to continue drilling the well. Similarly, when it is necessary to perform drill stem testing to assess conditions downhole, it may again be necessary to switch from CT drilling to jointed-pipe drilling and then back again. Finally, a switch back to jointed pipe operations is necessary to run casing into the drilled well. In short, in CT drilling operations it is generally necessary for customers and crew to switch back and forth between a CT drilling rig and a jointed-pipe conventional drilling rig, a process which results in significant down-time as one rig is moved out of the way, and the other rig put in place.

Another disadvantage of CT drilling is the time consuming process of assembling a (bottom-hole-assembly (BHA)—the components at the end of the CT for drilling, testing, well servicing, etc.), and connecting the BHA to the end of the CT. Presently, this step is performed manually through the use of rotary tables and make-up/breakout equipment. In some instances, top drives are used but the CT injector and the top drive must be moved out of each others way, i.e., they cannot both be in line with the borehole. Not only does this process result in costly downtime, but it can also present safety hazards to the workers as they are required to manipulate heavy components manually.

To address the problems above associated with the use of CT technology and provide for selective and rapid switching from the use of a CT injector to a top drive operation, certain so-called "universal" or "hybrid" rigs have been developed. Typical examples of the universal rigs, i.e., a rig which utilizes a single mast to perform both top drive and CT operations, the top drive and the CT injector being generally at all times operatively connected to the mast, are shown in United States Patent Publication 2004/0206551; and U.S. Pat. Nos. 6,003,598, and 6,609,565. Thus, in U.S. Publication 2004/0206551 there is disclosed a rig adapted to perform earth borehole operations using both CT and/or jointed-pipes, the CT injector and a top drive being mounted on the same mast, the CT injector being selectively moveable between a first position wherein the CT injector is in line with the mast of the rig and hence the earth borehole and a second position wherein the CT injector is out of line with the mast and hence the earth borehole.

In all of the systems disclosed in the aforementioned patents and publications, the reel of CT and the CT injector are on or are carried by the same carrier. Heretofore in CT operations particularly drilling, well depth has been limited to about 2200 meters because of governmental regulations regarding the weight and/or height of loads moving on highways. A CT injector can weigh from 2,500 to 39,000 lbs or more depending upon its size. As to the CT itself, 2200 meters of 3½" CT, including the reel upon which it is wound can weigh up to 100,000 lbs. Thus, because of governmental regulations regarding weight that can be transported on highways, reels of 3½" CT exceeding about 2200 meters cannot be transported on most highways since the combined weight of the CT and the CT injector would exceed the weight limitations. Clearly it is possible to transport greater lengths of smaller diameter, e.g., 2⅞" CT. However, particularly in using CT to conduct drilling operations at depths of about 2200 meters, the hydraulics of fluid flow, e.g., flow of drilling mud, dictate that the CT be 3½" or greater in diameter.

In copending U.S. patent application Ser. No. 11/300,842 filed Dec. 15, 2005 for a System, Method and Apparatus for Conducting Earth Borehole Operations, incorporated herein by reference for all purposes, one solution to overcoming height and weight problems vis-à-vis traveling on regulated roads/highways and the like is disclosed.

SUMMARY OF THE INVENTION

In one aspect, the present invention provides a system for use in conducting earth borehole operations, the system comprising a first support or carrier; a mast mounted on the first support; a second support or carrier; a skid carried on the second support; a CT injector carried on the skid, the skid being movable from the second carrier to the first carrier such that the CT injector is supported or carried on the first carrier, the CT carrier being movable from a first, transport position or mode, to a second, operational position or mode wherein the CT injector can insert or withdraw CT into and out of a wellbore; and a reel of CT for supplying CT to the CT injector.

DETAILED DESCRIPTION OF PREFERRED EMBODIMENTS

In the following description, the terms "carrier," "support," "substructure" may be used interchangeably as referring to any structure, be it fixed or movable, in the form of a trailer, skid, framework, etc., and which can carry or support a load, e.g., a CT injector, a mast with or without a top drive, a reel of CT or for that matter any other piece of equipment commonly used in hybrid rigs of the type under consideration. The word "skid" as used herein refers to any platform, framework or other type structure which can support a load as described above and which is capable of being moved from a first position or location to a second position or location by sliding movement, rolling movement, etc.

Figure 1:
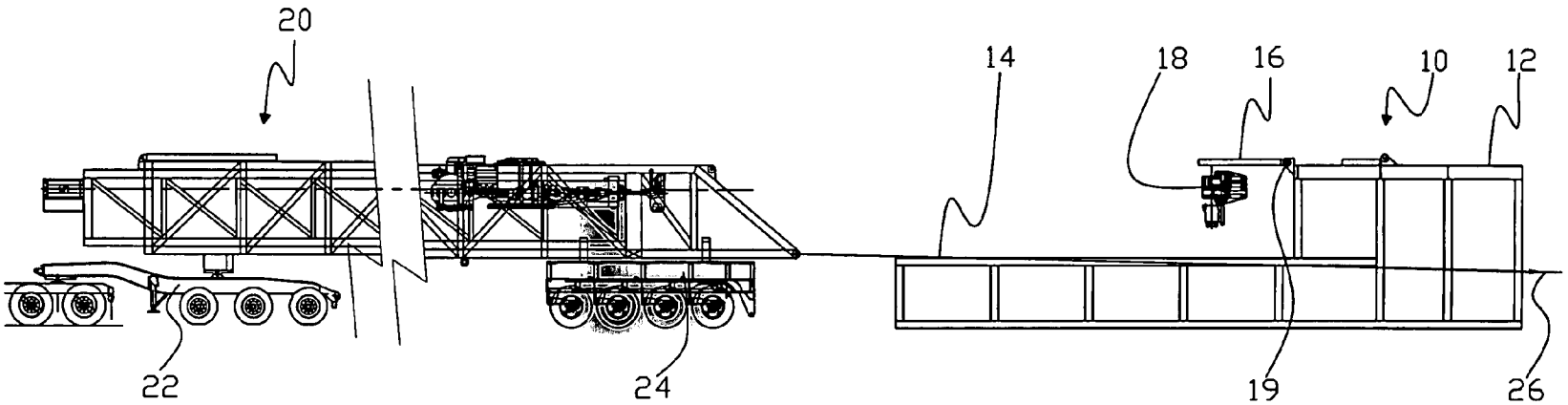
FIG. 1 is a side, elevational view showing a substructure, a wheeled carrier having a mast thereon to be connected to the substructure and a winch truck for moving the mast from the wheeled carrier to the substructure.

Referring then to FIG. 1, there is shown a substructure 10 having an upper platform or support surface 12 and a lower platform or support surface 14. As can be seen, substructure 10 is made up of a series of vertical and horizontal members forming a framework. Pivotally connected to upper platform 12 via a pivoting arm 16 is a powered make-up/breakout wrench 18, arm 16 being pivotally attached to a clevis-type connection 19.

Shown adjacent substructure 10 is a mast, indicated generally as 20, mast 20 being carried on a wheeled carrier comprising a front semi-trailer 22 and a rear booster trailer 24, both of trailers 22 and 24 being of the wheeled variety as shown and pulled by a tractor (not shown). Thus, mast 20 can be moved over highways and other terrain to a desired drilling site. Mast 20 is connected via a winch line 26 to the winch (not shown) of a winch truck (not shown) or some other hydraulic or mechanical system whereby mast 20 can be moved onto substructure 10 as described hereafter.

Figure 2:
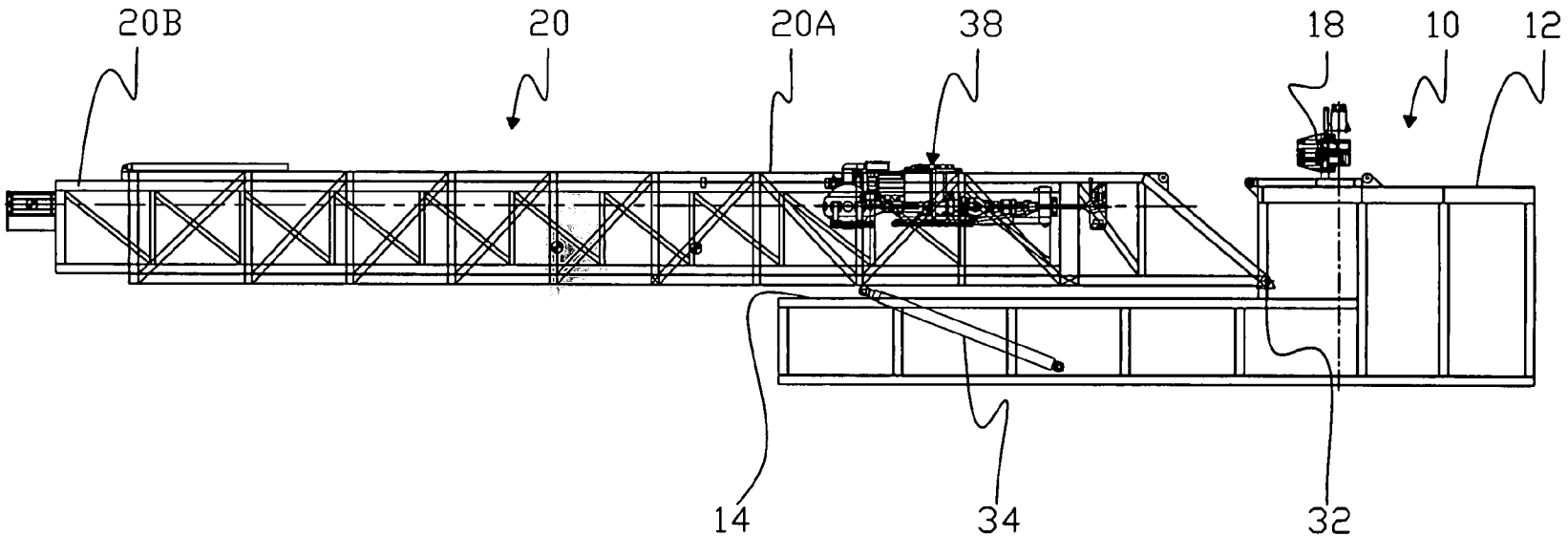
FIG. 2 is a side, elevational view showing the mast on the substructure pivotally attached thereof and in a generally horizontal disposition.

Turning now to FIG. 2, it can be seen that mast 20 has been moved onto lower platform 14 of substructure 10, the movement of mast 20 from the wheeled carrier shown in FIG. 1 to substructure 10 being accomplished by means of a winch line and winch as noted above. Additionally, mast 20 has been pivotally connected to substructure 10 at pivot connections 32, there being two of such connections.

Figure 3:
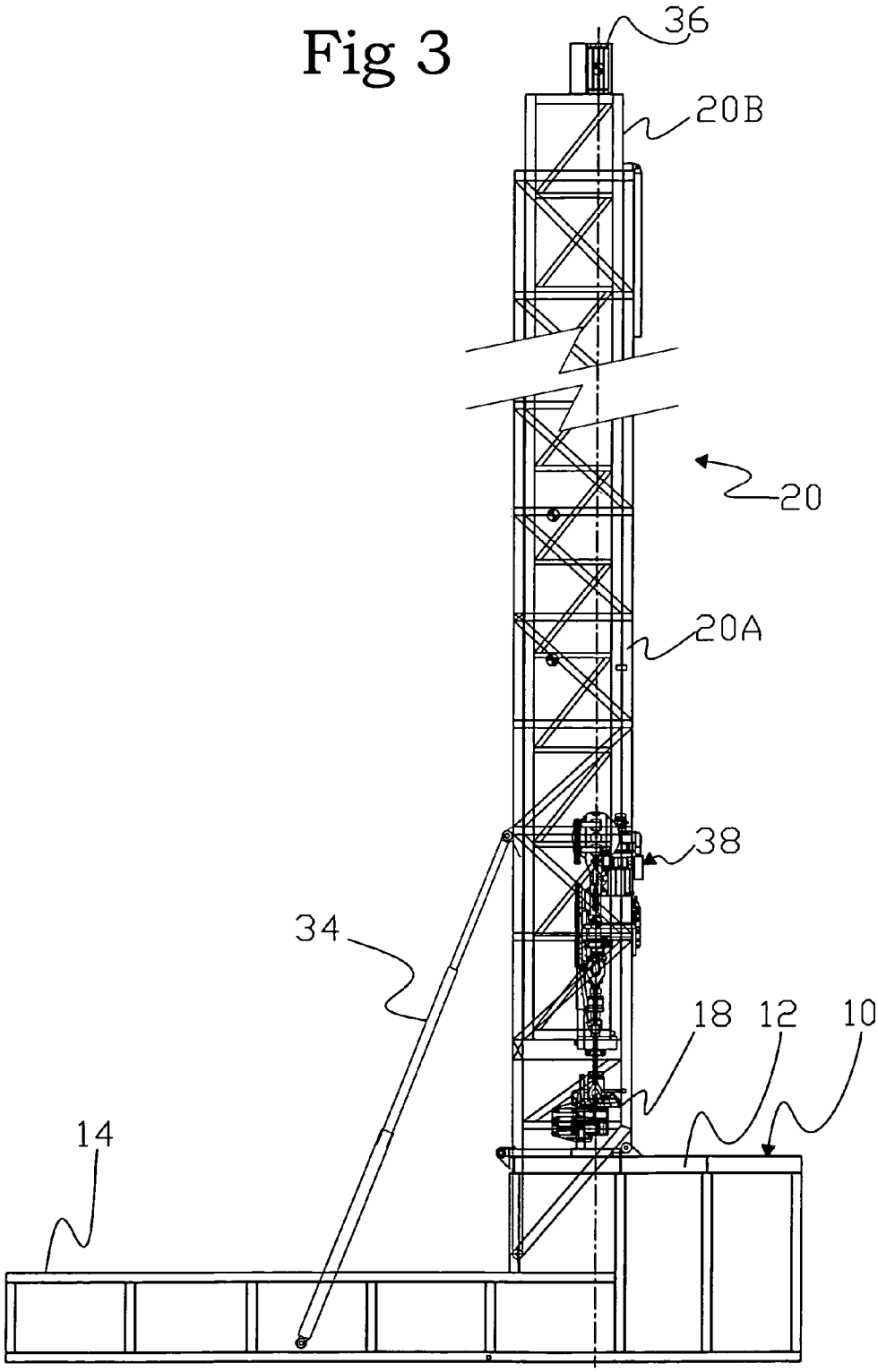
FIG. 3 is a side, elevational view showing the mast pivoted to a generally vertical position from the position shown in FIG. 2.

With reference to FIG. 3, it can be seen that mast 20 has been moved from the generally horizontal position shown in FIG. 2 to the generally vertical position shown in FIG. 3 by means of a hydraulic cylinder 34 connected to a suitable source of hydraulic power (not shown). It is also to be noted that mast 20 is of the telescoping variety comprising a first section 20A connected to substructure 10 and a second, telescoping section 20B, section 20B, as seen hereafter, being extended when necessary to handle stands of jointed pipe. A crown block assembly 36 is mounted on the upper end of telescoping section 20B of mast 20 and is connected by cables (not shown) to a top drive 38 which, in the well known manner, is carried in mast 20 and is movable longitudinally therealong. For example, mast 20 can comprise two or more spaced columns upon which are mounted rails, top drive 38 sliding or rolling along the rails so that top drive 38 may be moved to a desired position in mast 20. It will also be observed that powered wrench 18 has been moved to a position such that it is substantially in line with top drive 38.

Figure 4:
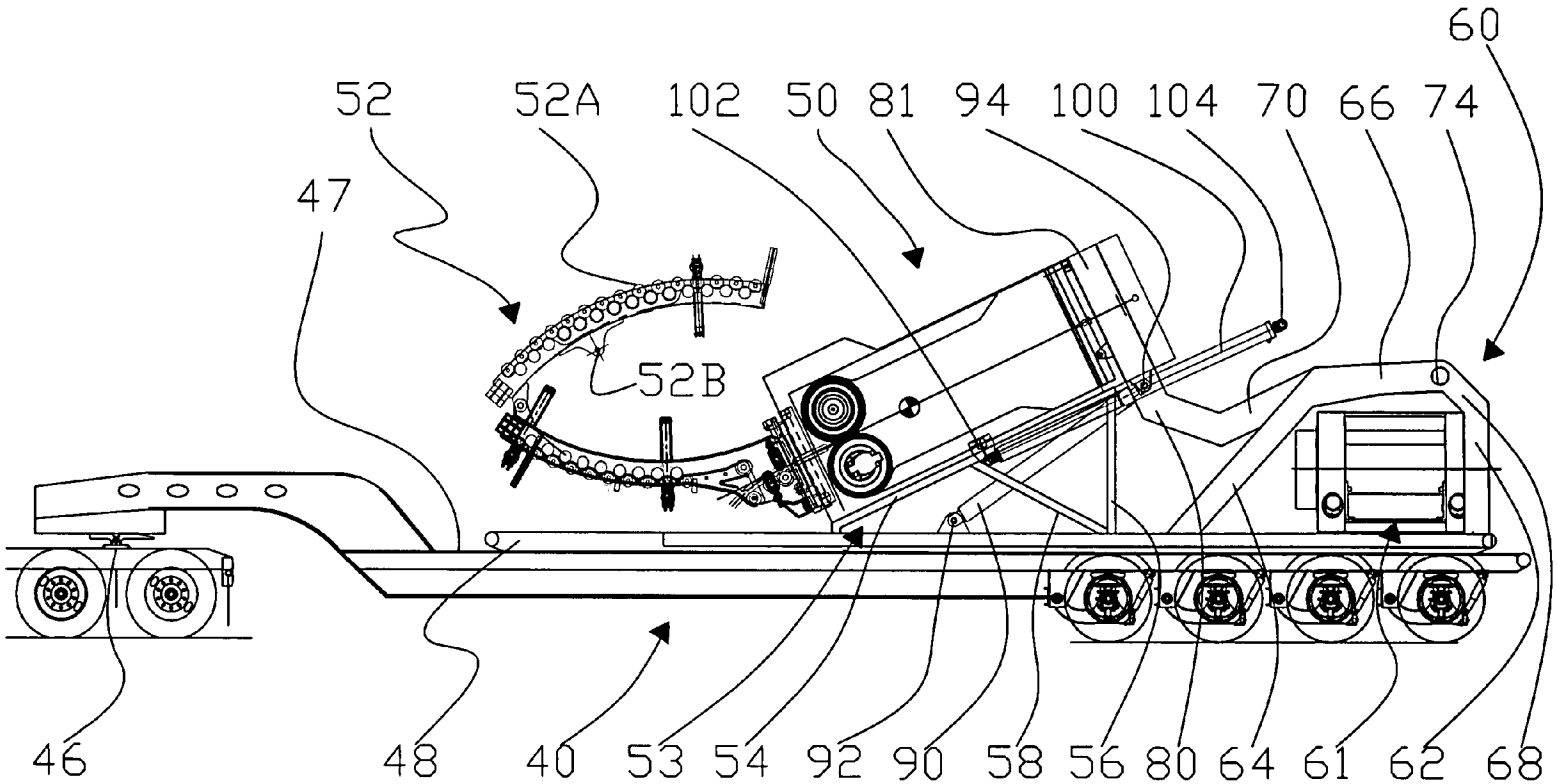
FIG. 4 is a side, elevational view of a wheeled carrier on which is supported or carried a skid, a CT injector being carried by the skid.

Referring now to FIG. 4, there is shown a fifth wheel trailer 40 connected to a tractor (not shown) by a fifth wheel connection 46. Resting on the bed 47 of trailer 40 is a skid 48 which is movable, e.g., slidable, on rollers, etc., on bed 47. Carried on skid 48 is a CT injector shown generally as 50. CT injector 50 is provided with an articulated gooseneck or guide shown generally as 52, guide 52 having a movable or articulating section 52A with a pivot point connector 52B for a purpose hereafter disclosed. As seen, CT injector 50 rests on a framework 53 comprised of inclined beams 54 which are connected to struts 56 and diagonal braces 58, struts 56 being attached to skid 48. Framework 53 can take many configurations and indeed any type of support which would hold CT 50 can be employed.

Figure 15:
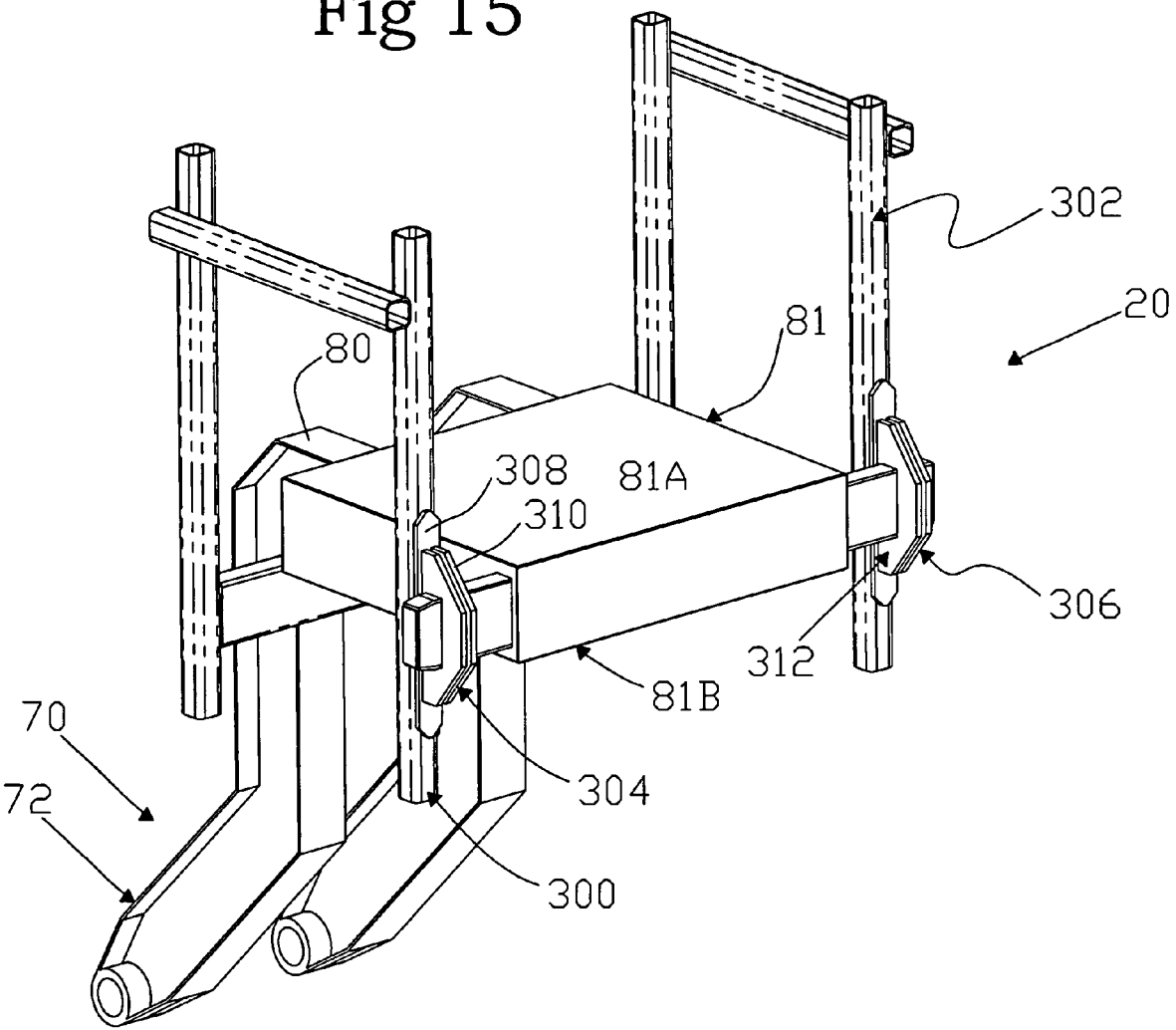
FIG. 15 is an isometric view of a portion of the mast and showing the pivoting support to which the CT injector is attached.

Attached to skid 48 is a frame, shown generally as 60, frame 60 comprising mirror image spaced frame members, only one of which is shown, frame 60 having a generally vertical strut 62, an angled brace 64 and a cross member 66, cross member 66 being connected to strut 62 by an elbow 68. CT injector 50 is connected to frame members 60 by means of first and second booms 70, booms 70 like frame members 60 being spaced apart (see FIG. 15). Booms 70 are generally L-shaped having one leg 72 which is pivotally connected at 74 to frame member 60. As seen in FIG. 15, boom 70 also have a second leg 80 which are attached to a box-like frame 81 which supports, it being understood that CT injector 50 would be connected to box frame 81. In effect, legs 80 of booms 70 together with any necessary bracing (not shown) frame 81 form a support for CT injector 60 to move CT injector 50 to a generally vertical position as shown hereafter. A hydraulic cylinder 90 is pivotally connected to skid 48 by clevis-like connectors 92 and is also connected by clevis-like connectors 94 to booms 70 it being understood that just as there are two frame members 60 and two booms 70, there are two cylinders 90. Shed 48 also carries a draw-works shown generally as 61.

A hydraulic cylinder 100 has one end pivotally attached as at 102 to CT injector 50. Hydraulic cylinder 100 is held in the position shown in FIG. 4 by any suitable latching mechanism. As seen hereafter, hydraulic cylinder 100 can be pivoted from the position shown in FIG. 4 to a position shown in FIG. 6 where it engages the articulating section 52A of guide 52. In this regard and as noted, section 52A of articulated guide 52 has a clevis-like connection 52B to which the end 104 of cylinder 100 can be attached when articulated guide 52 has been rotated to the position shown in FIG. 6.

Figure 5:
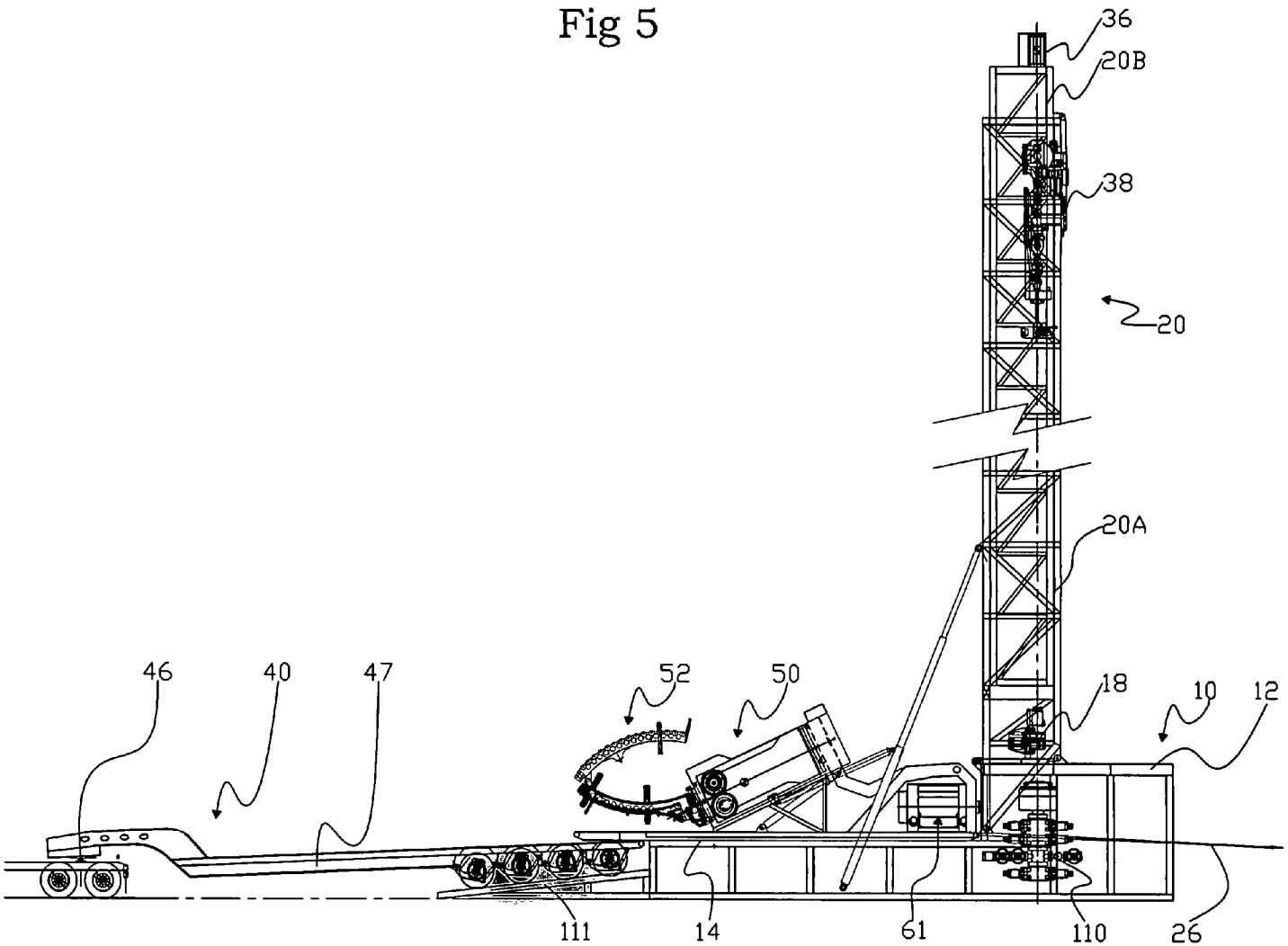
FIG. 5 is a side, elevational view showing the skid with the CT injector of FIG. 4 moved off of the wheeled carrier onto the substructure shown in FIG. 3.

Turning now to FIG. 5, it can be seen that, if necessary, trailer 40 has been backed up ramp 111 such that skid 48 can now be moved from the bed 47 of trailer 40 onto the lower platform or support surface 14 by means of winch line 26. In the configuration shown in FIG. 5, it is assumed that substructure 10 has been positioned such that the mast 20 is positioned relative to a wellbore (not shown) such that jointed pipe operations in the wellbore could be conducted using top drive 38. In this regard, powered wrench 18 and a blowout preventer 110 are substantially coaxial with the wellbore and with top drive 38.

Figure 6:
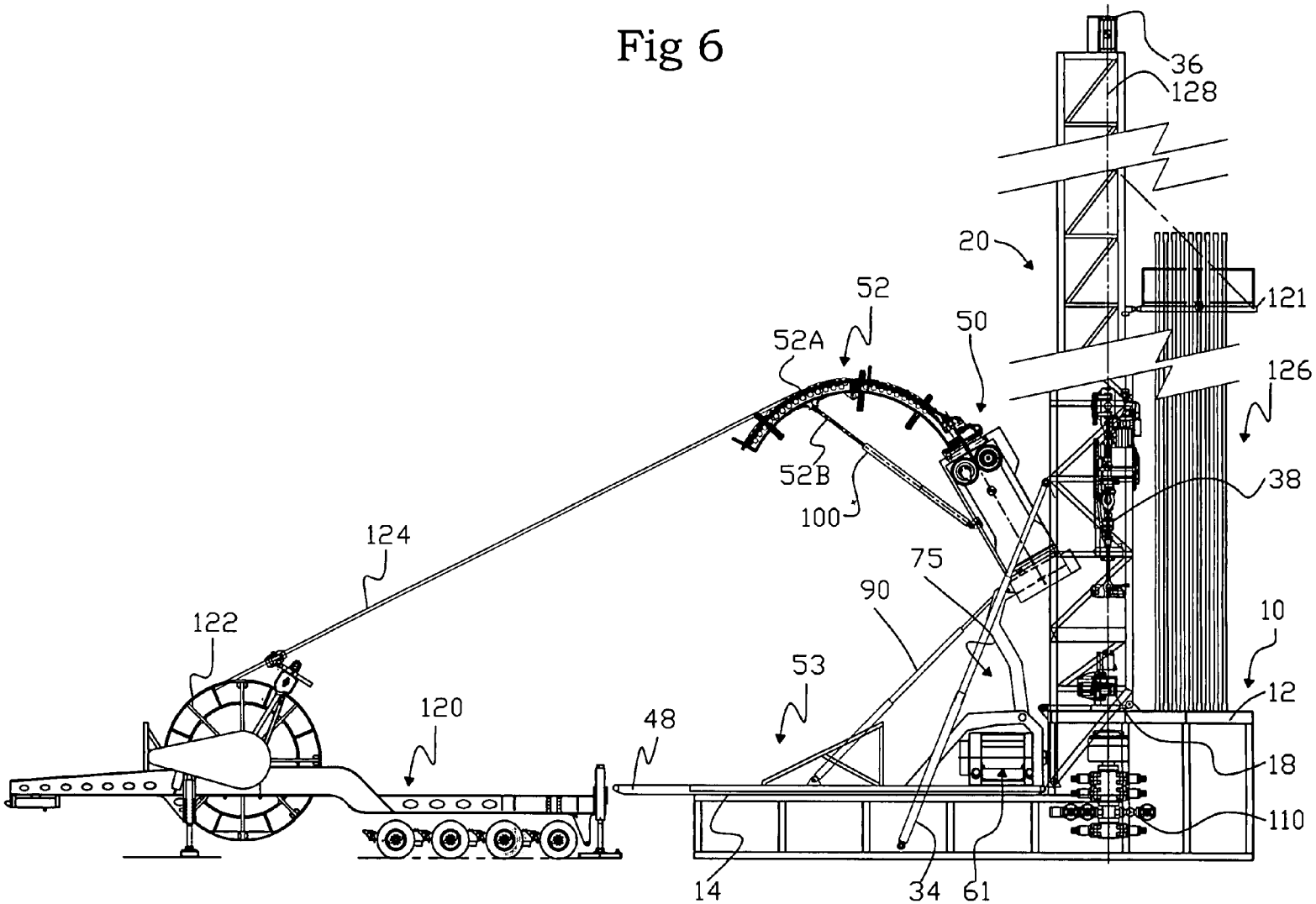
FIG. 6 is a side, elevational view showing the CT injector being moved from the transport position to an intermediate position, a third carrier with a reel of CT for supplying CT to the CT injector and a plurality of stands of jointed pipe on the substructure.

Turning now to FIG. 6, there is shown a trailer 120 carrying a reel 122 of CT 124 that has been positioned adjacent substructure 10. Additionally, guide or gooseneck 52 of CT injector 50 has been rotated, relative to CT injector 50, 180° from the position shown in FIG. 5 and articulating section 52A of gooseneck 52 has been attached to cylinder 100 at clevis-like connection 52B such that CT 124 can now be guided along gooseneck 52 into CT injector 50.

As can be further seen from FIG. 6, a tubular support or pipe rack 121 well known to those skilled in the art is attached to mast 20 and, holds a plurality of stands of pipe 126, the stands of pipe 126 generally comprising two or three individual threaded pipe sections. Typically, and when the pipe comprises drill pipe, each stand is approximately 90 feet long being made up from three threadedly engaged joints of drill pipe approximately 30 feet long. However, the stands of pipe 126 can comprise two joints of pipe approximately 45 feet long. It will be understood that the stands of pipe 126 can be drill pipe, casing, production tubing or virtually any other tubular commonly used in wellbore operations in the drilling, completion and/or workover of oil and gas wells. Reference is made in U.S. Pat. No. 4,077,525, incorporated herein by reference for all purposes, which shows a typical pipe rack for connection to a mast to hold the stands of pipe 126 such is shown in FIG. 6.

In the embodiment shown in FIG. 6, since CT injector 50 is in an inoperative position vis-à-vis injecting into or pulling out CT from the wellbore (not shown), top drive 38 could be used to manipulate the stands of pipe 126 to conduct any desired operation such as drilling, running casing, etc., typical usage being made of powered wrench 18 and BOP 110. As also can be seen in FIG. 6, a cable 128 extends from crown block 36 to top drive 38 such that top drive 38 can be moved longitudinally along the mast sections 20A and 20B to manipulate the jointed pipe stands 126. Additionally, although not shown, it will be understood that a cable(s) from drawworks 61 would run through crown block 36 to effect such movement of the top drive 38.

Figure 7:
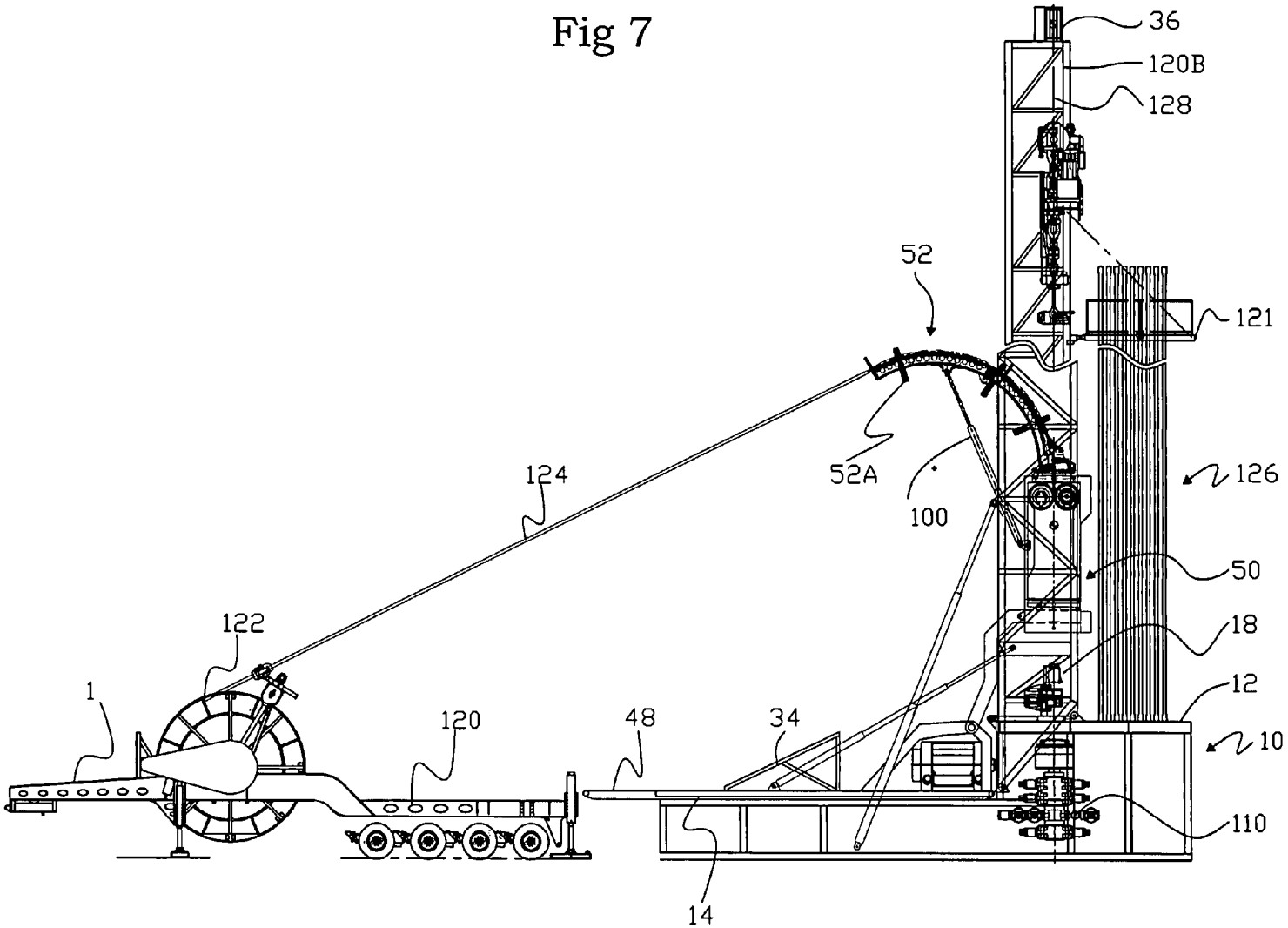
FIG. 7 is a view similar to FIG. 6 but showing a CT injector moved into an operative mode for conducting CT operations into a wellbore.

Referring now to FIG. 7, CT injector 50 has been moved into an operative position in mast 20, i.e., in a position where it can manipulate CT into and out of the wellbore. Thus, CT 124 issuing from CT injector 50 can pass through BOP 110 and into the wellbore. As is well known to those skilled in the art, when manipulating CT, it is normally not necessary that the CT pass through the powered wrench 18 and, accordingly, although powered wrench 18 is shown as being generally coaxial with CT injector 50 and BOP 110, powered wrench 18 could be moved to the position shown in FIG. 1.

Figure 8:
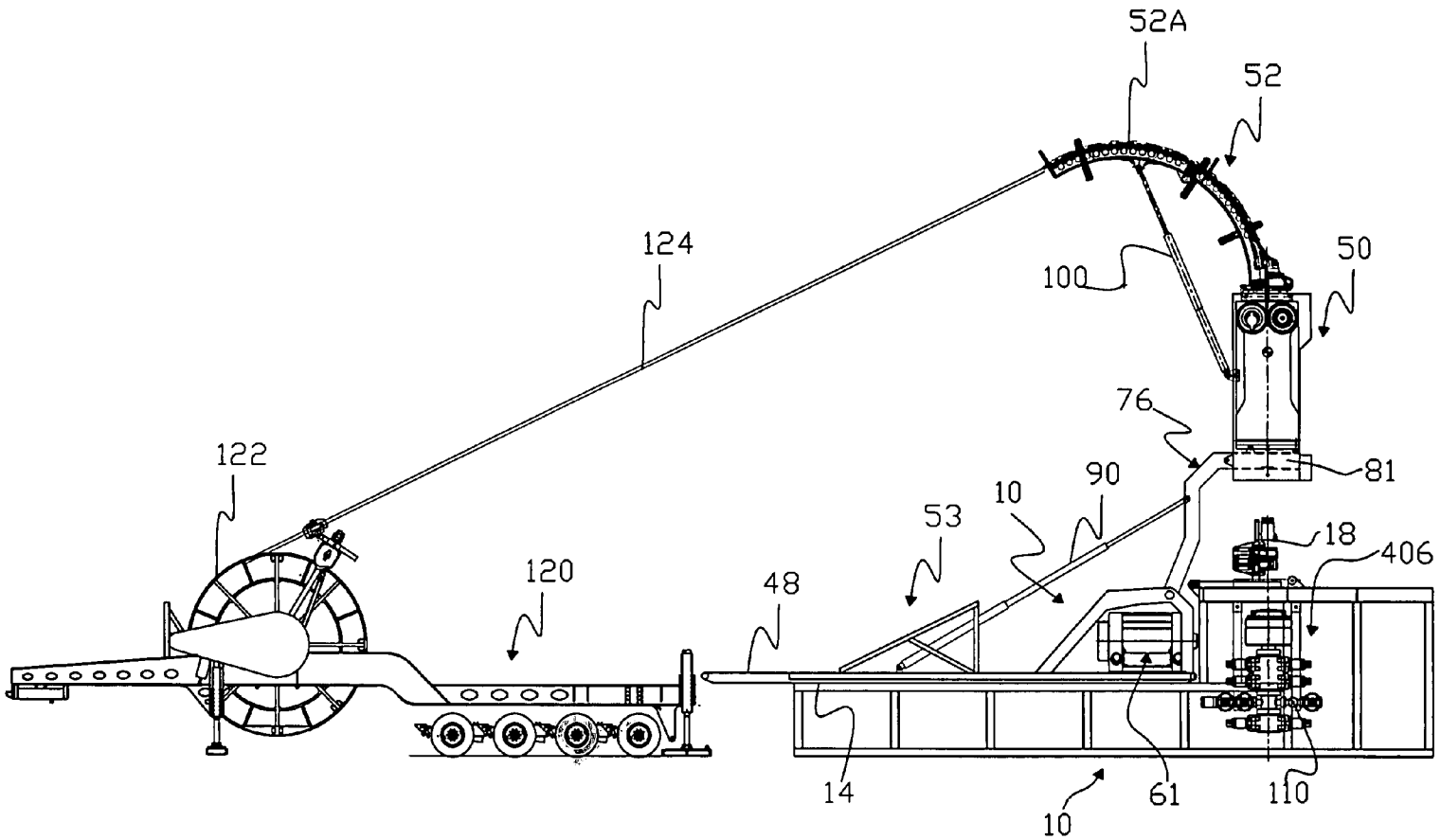
FIG. 8 is a side elevational view similar to FIG. 7 but in simplified form to show the CT injector suspended above the substructure.
Figure 9:
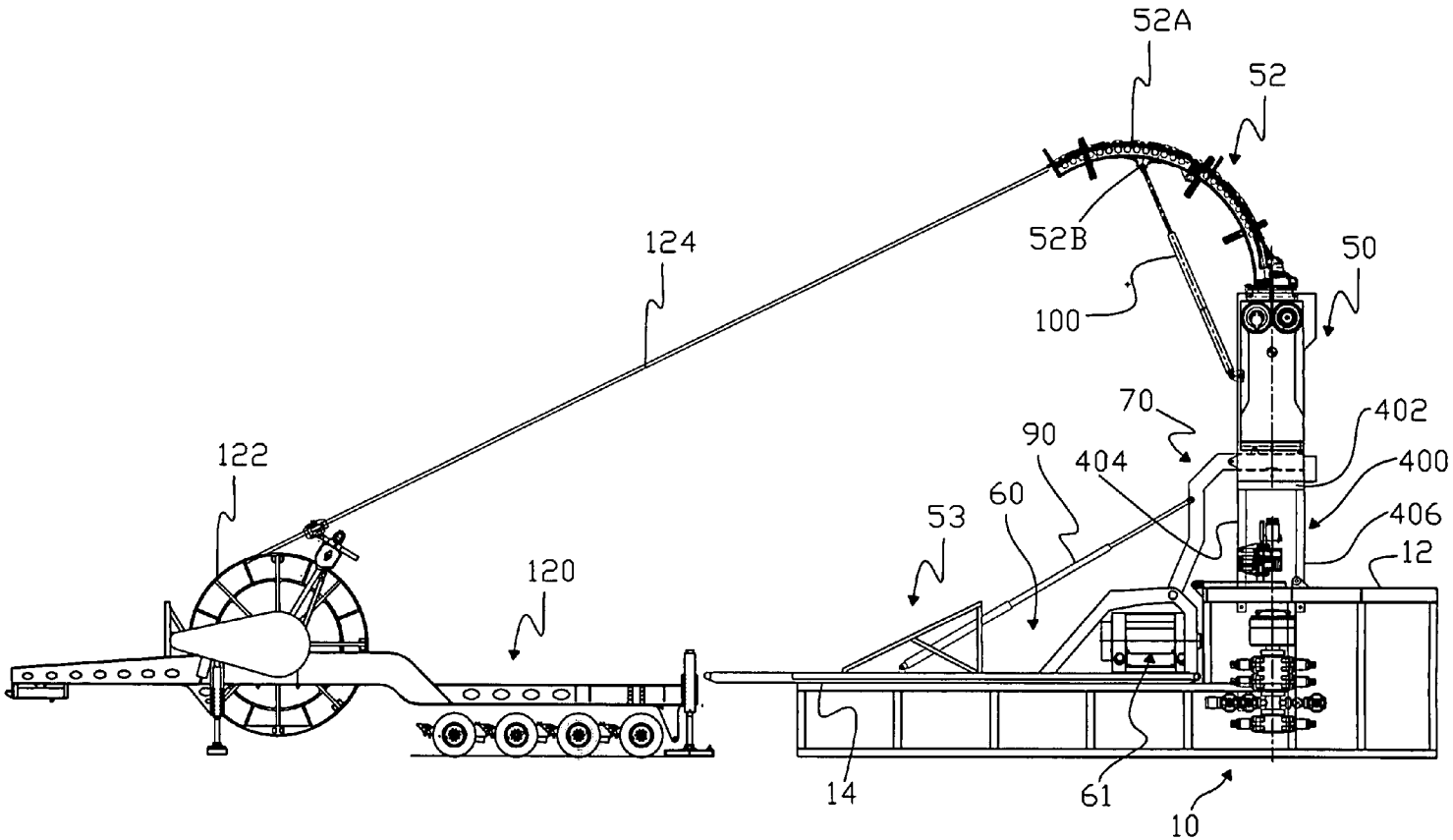
FIG. 9 is a view similar to FIG. 8 but showing the CT injector supported on a stand which telescopes out of the substructure.
Figure 11:
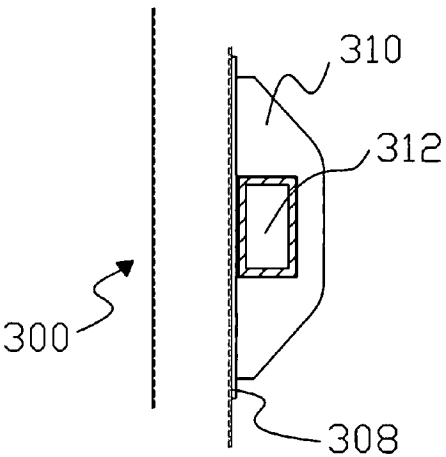
FIG. 11 is an elevational view showing a portion of the latching mechanism used to latch the CT injector to the mast and circled as A in FIG. 10.

Referring now to FIGS. 8 and 9, there is shown the system basically depicted in FIG. 7 except that for simplicity purposes mast 120, pipe rack 121, pipe stands 126, BOP 110, powered wrench 18 and other peripheral equipment have been removed for purposes of clarity.

As can be seen, there is a movable stand shown generally as 400 having a top 402 which forms a cradle or a support surface, the stand having four vertical legs only two of which, 404 and 406, are shown. As best seen with reference to FIG. 9, stand 400 can be telescoped from a lowered position shown in FIG. 8 to an elevated position shown in FIG. 9. In this regard, stand 400 can be moved up and down by the use of hydraulic cylinders, winches, gears or any other suitable mechanism. In the position shown in FIG. 8, stand 400 is in a retracted or lower position such that cradle or support 402 is at the level of support surface 12. In this position, CT injector 50 is axially spaced from the cradle 402. In the position shown in FIG. 8, CT injector 50 would either be suspended by means of booms 70 but in normal circumstances would be latched to mast 20 as described hereafter.

In the position shown in FIG. 9, with stand 400 raised, CT injector 50 can now rest on cradle or support surface 402. It is to be understood that in the raised position shown in FIG. 9, stand 400 could be suitably, releasably maintained in that position by means of pins or any other means. It is also to be understood that in the position shown in FIG. 9, CT injector 50 can be considered in an operative position in that it would be possible to manipulate CT into and out of the wellbore. In this condition, CT injector 50 could be unlatched from the mast since rather than the weight of the CT injector 50 and CT issuing therefrom being carried by mast 20, it would be carried by stand 400.

Figure 10:
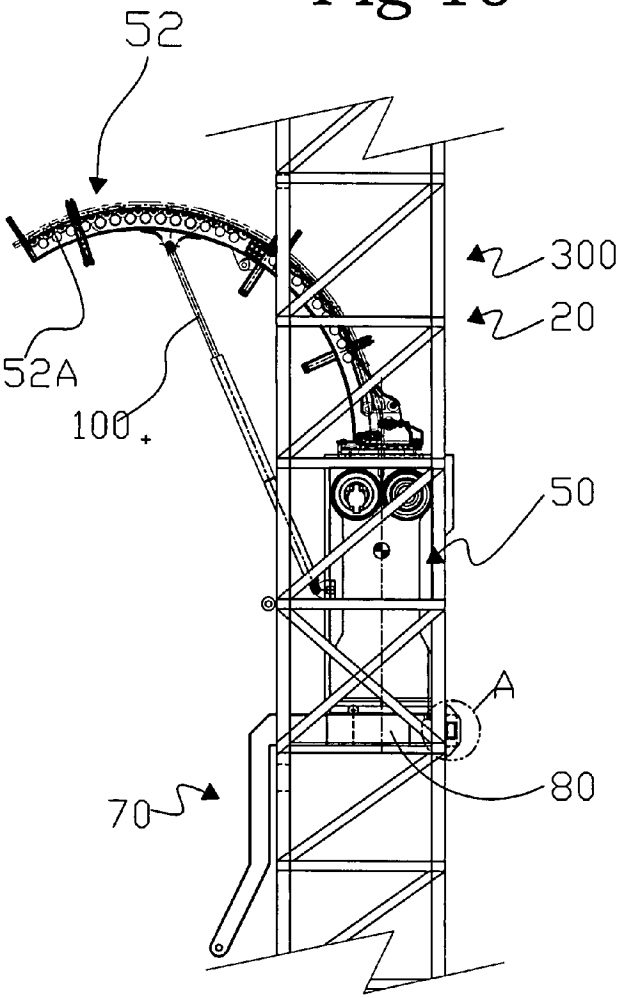
FIG. 10 is an elevational view showing the CT injector positioned in the mast and latched thereto.
Figure 13:
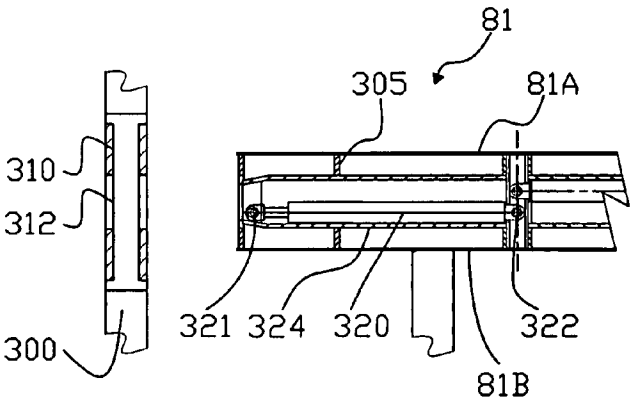
FIG. 13 is an enlarged, cross-sectional view of the area of FIG. 11 within the oval indicated as B showing the latching pins in a retracted position.
Figure 14:
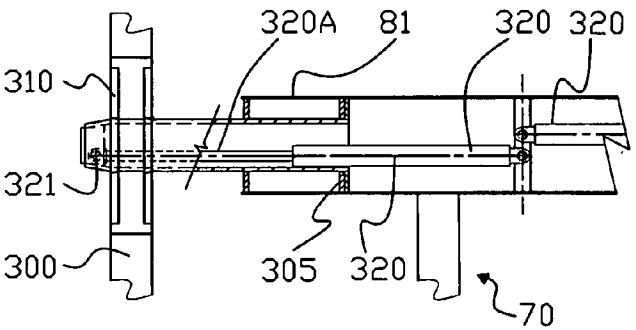
FIG. 14 is a view similar to FIG. 13 but showing the pins in the engaged position on the mast.
Figure 12:
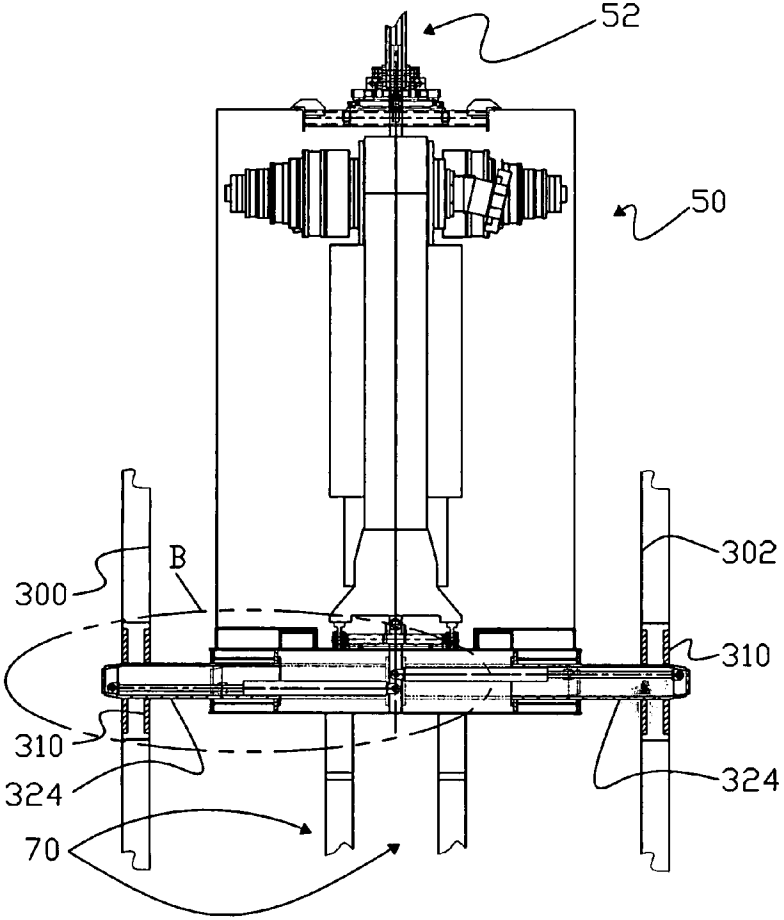
FIG. 12 is a reduced size, elevational view taken along the lines 12-12 of FIG. 10.

Referring now to FIG. 10, the CT injector is basically in the position shown in FIG. 7, i.e., in an operational mode and being latched to the mast 20. As best seen with reference to FIGS. 10-15, mast 20 is comprised of spaced column members 300 and 302. Attached, as by welding to columns 300 and 302, are brackets 304 and 306 which are of like construction and comprise plate 308 to which are attached as by welding a pair of spaced ears 310, ears 310 having registering openings 312, which, as shown, are generally rectangular in configuration. Mounted in box-like frame 81 attached the legs 80 of booms 70, are a pair of hydraulic cylinders 320, cylinders 320 being attached to a cross piece 322 as best seen in FIG. 13. The end of the piston rods 320A of hydraulic cylinder 320, are connected as at 321 to a pin 324 which, as shown in FIGS. 13 and 14 is movable from a first, retracted position shown in FIG. 13, to a second extended position shown in FIG. 14. A stop plate 305 in box frame 81 limits movement of pins 324. As can be seen with reference to FIGS. 12-15, once hydraulic cylinders 320 are activated by a source of hydraulic power not shown, piston rods 323 move pins 324 to the position shown in FIG. 14 such that the pins 324 extend through the openings 312 in the ears 310. In this position, the CT injector 50 is now latched to the mast 20 such that mast 20 can carry not only the weight of the CT injector 50 but also the weight of any CT issuing therefrom. Box frame 81 has upper and lower plates 81A and 81B inside of which is a framework partially shown in FIGS. 13 and 14. Plate 81A forms a surface on which CT injector can rest, it being understood that CT injector 50 will be secured to box frame 81 by a suitable means such that CT injector can be pivoted from the position shown in FIG. 4 to the position shown in FIG. 7 and indeed in any intermediate position.

As can be seen from the above description, the hybrid system of the present invention provides numerous advantages over prior art systems. For one, since the coil of CT, the CT injector and the mast can all be on separate, wheeled carriers if desired, the system can be more easily moved along regulated highways without exceeding weight restrictions.

Thus, the system of the present invention is ideal for conducting CT drilling operations in wells as deep as 3,000 to 4,000 meters.

In the description above, reference has been made to CT injector 50 resting on skid 48. It is to be understood, as noted above, that skid 48 can comprise any structure which is movable, e.g., from trailer 40 to first support 10, and which has a surface, framework or the like to support CT injector 50. In point of fact, support 10 is usually of the skid form having a framework as shown and which provides working platforms for rig personnel as well as a support or carrier for mast 20 and skid 48. Thus, support 10 can be winched onto a trailer for transport to a desired site. Accordingly, skid is in no manner intended to be limited to a sliding structure but rather to a movable structure which has the capability of supporting a load, e.g., CT injector 50.

In the description above, the word "surface" has been used in referring to various structural elements of the hybrid system of the present invention. The word "surface" as used herein is intended to include not only a planar or substantially planar surfaces but any system or structure which can be comprised of beams or other support members which can cooperatively act to provide a support, be it a platform or the like, upon which a load, e.g., skid 48, can rest.

In the description above, the terms "operatively attached" or "operatively connected to" or similar terms employing the word "operatively" may have been employed. Those terms are intended to mean, for example, that if Component A is being described as operatively attached to Component B, Component A may be directly attached to Component B or can be attached to Component B via Component C, the net result being that Component A and Component B are interconnected in such a way that both Component A and Component B can perform in their intended manner. For example, if it is stated that the CT injector is operatively attached to the frame on the skid, the connotation is that the CT injector is interconnected to the frame, directly or by some intermediate component which permits the CT injector to, in this case, be moved between various positions with the frame as a supporting member.

It will be understood that while not shown, the various trailers, carriers, etc., would have, to the extent necessary, power sources such as motors, generators, hydraulic systems and the like, as is conventionally used in conducting earth borehole operations of the type under consideration, i.e., drilling, completion and/or workover of oil and gas wells or for that matter any type of earth borehole, e.g., water well, wells or boreholes used in mining, etc.

The foregoing description and examples illustrate selected embodiments of the present invention. In light thereof, variations and modifications will be suggested to one skilled in the art, all of which are in the spirit and purview of this invention.

What is claimed is:

1. A system for conducting earth borehole operations comprising:

a first support;

a mast attached to said first support;

a top drive carried by said mast for longitudinal movement therealong;

a second support, said first and second supports being independently movable;

a skid carried by said second support, said skid being movable from said second support to said first support;

a coiled tubing (CT) injector carried by said skid, said skid being movable from said second support to said first support, said CT injector being movable from a first position on said skid to a second position in line with and under said top drive;

a reel of CT for supplying said CT injector with CT; and a drawworks carried by said skid and a cable from said drawworks operatively connected to said top drive for moving said top drive longitudinally along said mast.

2. The system of claim 1, wherein said skid is movable from said second support to said first support.

3. The system of claim 1, wherein said first support comprises a substructure having a first support surface and a second, lower support surface and said skid is movable to said second, lower support surface.

4. The system of claim 3, wherein said first support comprises first and second surfaces, said mast being above said first support surface when in said vertical position, said skid being movable to said second support surface, said CT injector being movable from above said second support surface to a position above said first support surface when said mast is moved to said vertical position.

5. The system of claim 4, wherein said CT injector is in line with said top drive and in an operational mode when said CT injector is above said first support surface.

6. The system of claim 5, wherein said CT injector is pivoted from a transport mode when above said second surface to said operational mode when above said first surface.

7. The system of claim 1, wherein said mast is removably and pivotally supported on said first support.

8. The system of claim 1, wherein said mast is movable from a first, generally horizontal position to a second, generally vertical position.

9. The system of claim 1, wherein there is a frame carried by said skid and said CT injector is operatively attached to said frame.

10. The system of claim 9, wherein said frame comprises first and second spaced frame members and there are first and second, spaced booms pivotally secured to said first and second frame members, respectively, said first and second booms being operatively attached to said CT injector.

11. The system of claim 1, wherein said CT injector can be pivoted from said first position on said skid to said second position in line with said top drive.

12. The system of claim 1, wherein said first support includes a vertically movable stand, said stand being movable from a first stand, position to a second, stand, position wherein when said CT injector is in said operational mode wherein, said CT injector can rest on said stand.

13. The system of claim 1, wherein said reel of CT is on a third support.

14. The system of claim 1, wherein said mast comprises first and second telescoping sections.

15. The system of claim 1, wherein there are a plurality of stands of pipe vertically positioned adjacent said mast, said pipe stands being adapted to being manipulated by said top drive.

16. The system of claim 15, wherein there is a pipe rack attached to said mast, said plurality of stands of pipe being releasably held in said pipe rack.

17. The system of claim 1, wherein when said CT injector is in said second position, said mast is in a generally vertical position and said CT injector is latched to said mast whereby said mast can support the weight of said CT injector and any CT issuing therefrom.

18. A system for conducting earth borehole operations comprising:

a first support, said first support comprising a substructure having a first support surface and a second, lower support surface;

a mast attached to said first support;

a top drive carried by said mast for longitudinal movement therealong;

a second support, said first and second supports being independently movable;

a skid carried by said second support, said skid being movable from said second support to said second lower support surface of said first support;

a conventional coiled tubing (CT) injector carried by said skid, said skid being movable from said second support to said first support by translational movement of said skid, said CT injector being movable from a first position on said skid to a second position in line with and under said top drive; and a reel of CT for supplying said CT injector with CT, said reel of CT not being carried by said skid.

19. The system of claim 18, wherein said mast is removably and pivotally supported on said first support.

20. The system of claim 18, wherein said mast is movable from a first, generally horizontal position to a second, generally vertical position.

21. The system of claim 18, wherein there is a frame carried by said skid and said CT injector is operatively attached to said frame.

22. The system of claim 21, wherein said frame comprises first and second spaced frame members and there are first and second, spaced booms pivotally secured to said first and second frame members, respectively, said first and second booms being operatively attached to said CT injector.

23. The system of claim 18, wherein said CT injector can be pivoted from said first position on said skid to said second position in line with said top drive.

24. The system of claim 18, wherein said first support includes a vertically movable stand, said stand being movable from a first stand, position to a second, stand, position wherein when said CT injector is in said operational mode wherein, said CT injector can rest on said stand.

25. The system of claim 18, wherein said reel of CT is on a third support.

26. The system of claim 18, wherein said mast comprises first and second telescoping sections.

27. The system of claim 18, wherein there are a plurality of stands of pipe vertically positioned adjacent said mast, said pipe stands being adapted to being manipulated by said top drive.

28. The system of claim 27, wherein there is a pipe rack attached to said mast, said plurality of stands of pipe being releasably held in said pipe rack.

29. The system of claim 18, wherein there is a drawworks carried by said skid and there is cable from said drawworks operatively connected to said top drive for moving said top drive longitudinally along said mast.

30. The system of claim 18, wherein when said CT injector is in said second position, said mast is in a generally vertical position and said CT injector is latched to said mast whereby said mast can support the weight of said CT injector and any CT issuing therefrom.

31. The system of claim 18, wherein said mast is above said first support surface when in said vertical position, said CT injector being movable from above said second support surface to a position above said first support surface when said mast is moved to said vertical position.

32. The system of claim 31, wherein said CT injector is in line with said top drive and in an operational mode when said CT injector is above said first support surface.

33. The system of claim 32, wherein said CT injector is pivoted from a transport mode when above said second surface to said operational mode when above said first surface.

34. A system for conducting earth borehole operations comprising:

a first support;

a mast attached to said first support;

a top drive carried by said mast for longitudinal movement therealong;

a second support, said first and second supports being independently movable;

a skid carried by said second support, said skid being movable from said second support to said first support;

a conventional coiled tubing (CT) injector carried by said skid, said skid being movable from said second support to said first support by translational movement of said skid, said CT injector being movable from a first position on said skid to a second position in line with and under said top drive; and a reel of CT for supplying said CT injector with CT, said reel of CT being on a third support.

35. The system of claim 34, wherein said mast is removably and pivotally supported on said first support.

36. The system of claim 34, wherein said mast is movable from a first, generally horizontal position to a second, generally vertical position.

37. The system of claim 34, wherein there is a frame carried by said skid and said CT injector is operatively attached to said frame.

38. The system of claim 37, wherein there are first and second, spaced booms pivotally secured to said frame, said first and second booms being selectively, operatively attached to said CT injector.

39. The system of claim 34, wherein said CT injector can be pivoted from said first position on said skid to said second position in line with said top drive.

40. The system of claim 34, wherein said first support includes a vertically movable stand, said stand being movable from a first stand, position to a second, stand, position wherein when said CT injector is in said operational mode wherein, said CT injector can rest on said stand.

41. The system of claim 34, wherein said mast comprises first and second telescoping sections.

42. The system of claim 34, wherein there are a plurality of stands of pipe vertically positioned adjacent said mast, said pipe stands being adapted to being manipulated by said top drive.

43. The system of claim 42, wherein there is a pipe rack attached to said mast, said plurality of stands of pipe being releasably held in said pipe rack.

44. The system of claim 34, wherein there is a drawworks carried by said skid and there is cable from said drawworks operatively connected to said top drive for moving said top drive longitudinally along said mast.

45. The system of claim 34, wherein when said CT injector is in said second position, said mast is in a generally vertical position and said CT injector is latched to said mast whereby said mast can support the weight of said CT injector and any CT issuing therefrom.

46. The system of claim 34, wherein said first support comprises first and second surfaces, said mast being above said first support surface when in said vertical position, said skid being movable to said second support surface, said CT injector being movable from above said second support surface to a position above said first support surface when said mast is moved to said vertical position.

47. The system of claim 46, wherein said CT injector is in line with said top drive and in an operational mode when said CT injector is above said first support surface.

48. The system of claim 47, wherein said CT injector is pivoted from a transport mode when above said second surface to said operational mode when above said first surface.

49. A system for conducting earth borehole operations comprising:

a first support;

a mast attached to said first support;

a top drive carried by said mast for longitudinal movement therealong;

a second support, said first and second supports being independently movable;

a skid carried by said second support, said skid being movable from said second support to said first support;

a conventional coiled tubing (CT) injector carried by said skid, said skid being movable from said second support to said first support by translational movement of said skid, said CT injector being movable from a first position on said skid to a second position in line with and under said top drive;

a reel of CT for supplying said CT injector with CT, said reel of CT not being carried by said skid; and a drawworks carried by said skid, a cable from said drawworks operatively connected to said top drive for moving said top drive longitudinally along said mast.

50. The system of claim 49, wherein said first support comprises a substructure having a first support surface and a second, lower support surface and said skid is movable to said second, lower support surface.

51. The system of claim 49, wherein said mast is removably and pivotally supported on said first support.

52. The system of claim 49, wherein said mast is movable from a first, generally horizontal position to a second, generally vertical position.

53. The system of claim 49, wherein there is a frame carried by said skid and said CT injector is operatively attached to said frame.

54. The system of claim 53, wherein there are first and second, spaced booms pivotally secured to said frame, said first and second booms being operatively attached to said CT injector.

55. The system of claim 49, wherein said CT injector can be pivoted from said first position on said skid to said second position in line with said top drive.

56. The system of claim 49, wherein said first support includes a vertically movable stand, said stand being movable from a first stand, position to a second, stand, position wherein when said CT injector is in said operational mode wherein, said CT injector can rest on said stand.

57. The system of claim 49, wherein said reel of CT is on a third support.

58. The system of claim 49, wherein said mast comprises first and second telescoping sections.

59. The system of claim 49, wherein there are a plurality of stands of pipe vertically positioned adjacent said mast, said pipe stands being adapted to being manipulated by said top drive.

60. The system of claim 59, wherein there is a pipe rack attached to said mast, said plurality of stands of pipe being releasably held in said pipe rack.

61. The system of claim 49, wherein when said CT injector is in said second position, said mast is in a generally vertical position and said CT injector is latched to said mast whereby said mast can support the weight of said CT injector and any CT issuing therefrom.

62. The system of claim 50, wherein said first support comprises first and second surfaces, said mast being above said first support surface when in said vertical position, said skid being movable to said second support surface, said CT injector being movable from above said second support surface to a position above said first support surface when said mast is moved to said vertical position.

63. The system of claim 62, wherein said CT injector is in line with said top drive and in an operational mode when said CT injector is above said first support surface.

64. The system of claim 63, wherein said CT injector is pivoted from a transport mode when above said second surface to said operational mode when above said first surface.

65. A system for conducting earth borehole operations comprising:

a first support, said first support comprises a substructure having a first support surface and a second, lower support surface and said skid is movable to said second, lower support surface;

a mast attached to said first support;

a top drive carried by said mast for longitudinal movement therealong;

a second support, said first and second supports being independently movable;

a skid carried by said second support, said skid being movable from said second support to said first support by translational movement of said skid;

a conventional coiled tubing (CT) injector carried by said skid, said skid being movable from said second support to said first support, said CT injector being movable from a first position on said skid to a second position in line with and under said top drive;

a reel of CT for supplying said CT injector with CT; and a vertically movable stand on said first support, said stand being movable from a first stand, position to a second, stand, position wherein when said CT injector is in said operational mode wherein said CT injector can rest on said stand.

66. The system of claim 65, wherein said mast is removably and pivotally supported on said first support.

67. The system of claim 65, wherein said mast is movable from a first, generally horizontal position to a second, generally vertical position.

68. The system of claim 65, wherein there is a frame carried by said skid and said CT injector is operatively attached to said frame.

69. The system of claim 68, wherein there are first and second, spaced booms pivotally secured to said frame, said first and second booms being operatively attached to said CT injector.

70. The system of claim 65, wherein said CT injector can be pivoted from said first position on said skid to said second position in line with said top drive.

71. The system of claim 65, wherein said reel of CT is on a third support.

72. The system of claim 65, wherein said mast comprises first and second telescoping sections.

73. The system of claim 65, wherein there are a plurality of stands of pipe vertically positioned adjacent said mast, said pipe stands being adapted to being manipulated by said top drive.

74. The system of claim 73, wherein there is a pipe rack attached to said mast, said plurality of stands of pipe being releasably held in said pipe rack.

75. The system of claim 65, wherein there is a drawworks carried by said skid and there is cable from said drawworks operatively connected to said top drive for moving said top drive longitudinally along said mast.

76. The system of claim 65, wherein when said CT injector is in said second position, said mast is in a generally vertical position and said CT injector is latched to said mast whereby said mast can support the weight of said CT injector and any CT issuing therefrom.

77. The system of claim 65, wherein said mast is above said first support surface when in said vertical position, said CT injector being movable from above said second support surface to a position above said first support surface when said mast is moved to said vertical position.

78. The system of claim 77, wherein said CT injector is in line with said top drive and in an operational mode when said CT injector is above said first support surface.

79. The system of claim 78, wherein said CT injector is pivoted from a transport mode when above said second surface to said operational mode when above said first surface.

80. A system for conducting earth borehole operations comprising:

a first support, said first support comprises a substructure having a first support surface and a second, lower support surface and said skid is movable to said second, lower support surface;

a mast attached to said first support;

a top drive carried by said mast for longitudinal movement therealong;

a second support, said first and second supports being independently movable;

a skid carried by said second support, said skid being movable from said second support to said first support by translational movement of said skid;

a conventional coiled tubing (CT) injector carried by said skid, said skid being movable from said second support to said first support, said CT injector being movable from a first position on said skid to a second position in line with and under said top drive; and a reel of CT for supplying said CT injector with CT, said reel of CT being carried on a third support.

81. The system of claim 80, wherein said mast is removably and pivotally supported on said first support.

82. The system of claim 80, wherein said mast is movable from a first, generally horizontal position to a second, generally vertical position.

83. The system of claim 80, wherein there is a frame carried by said skid and said CT injector is operatively attached to said frame.

84. The system of claim 83, wherein there are first and second, spaced booms pivotally secured to said frame, said first and second booms being operatively attached to said CT injector.

85. The system of claim 80, wherein said CT injector can be pivoted from said first position on said skid to said second position in line with said top drive.

86. The system of claim 80, wherein said first support includes a vertically movable stand, said stand being movable from a first stand, position to a second, stand, position wherein when said CT injector is in said operational mode wherein, said CT injector can rest on said stand.

87. The system of claim 80, wherein said mast comprises first and second telescoping sections.

88. The system of claim 80, wherein there are a plurality of stands of pipe vertically positioned adjacent said mast, said pipe stands being adapted to being manipulated by said top drive.

89. The system of claim 88, wherein there is a pipe rack attached to said mast, said plurality of stands of pipe being releasably held in said pipe rack.

90. The system of claim 80, wherein there is a drawworks carried by said skid and there is cable from said drawworks operatively connected to said top drive for moving said top drive longitudinally along said mast.

91. The system of claim 80, wherein when said CT injector is in said second position, said mast is in a generally vertical position and said CT injector is latched to said mast whereby said mast can support the weight of said CT injector and any CT issuing therefrom.

92. The system of claim 80, wherein said mast is above said first support surface when in said vertical position, said CT injector being movable from above said second support surface to a position above said first support surface when said mast is moved to said vertical position.

93. The system of claim 92, wherein said CT injector is in line with said top drive and in an operational mode when said CT injector is above said first support surface.

94. The system of claim 93, wherein said CT injector is pivoted from a transport mode when above said second surface to said operational mode when above said first surface.

95. A system for conducting earth borehole operations comprising:

a first support, said first support comprises a substructure having a first support surface and a second, lower support surface and said skid is movable to said second, lower support surface;

a mast attached to said first support; said mast comprising first and second telescopic sections;

a top drive carried by said mast for longitudinal movement therealong;

a second support, said first and second supports being independently movable;

a skid carried by said second support, said skid being movable from said second support to said first support by translational movement of said skid;

a conventional coiled tubing (CT) injector carried by said skid, said skid being movable from said second support to said first support, said CT injector being movable from a first position on said skid to a second position in line with and under said top drive; and a reel of CT for supplying said CT injector with CT.

96. The system of claim 95, wherein said mast is removably and pivotally supported on said first support.

97. The system of claim 95, wherein said mast is movable from a first, generally horizontal position to a second, generally vertical position.

98. The system of claim 95, wherein there is a frame carried by said skid and said CT injector is operatively attached to said frame.

99. The system of claim 98, wherein there are first and second, spaced booms pivotally secured to said frame, said first and second booms being selectively, operatively attached to said CT injector.

100. The system of claim 95, wherein said CT injector can be pivoted from said first position on said skid to said second position in line with said top drive.

101. The system of claim 95, wherein said first support includes a vertically movable stand, said stand being movable from a first stand, position to a second, stand, position wherein when said CT injector is in said operational mode wherein, said CT injector can rest on said stand.

102. The system of claim 95, wherein said reel of CT is on a third support.

103. The system of claim 95, wherein there are a plurality of stands of pipe vertically positioned adjacent said mast, said pipe stands being adapted to being manipulated by said top drive.

104. The system of claim 103, wherein there is a pipe rack attached to said mast, said plurality of stands of pipe being releasably held in said pipe rack.

105. The system of claim 95, wherein there is a drawworks carried by said skid and there is cable from said drawworks operatively connected to said top drive for moving said top drive longitudinally along said mast.

106. The system of claim 95, wherein when said CT injector is in said second position, said mast is in a generally vertical position and said CT injector is latched to said mast whereby said mast can support the weight of said CT injector and any CT issuing therefrom.

107. The system of claim 95, wherein said mast is above said first support surface when in said vertical position, said CT injector being movable from above said second support surface to a position above said first support surface when said mast is moved to said vertical position.

108. The system of claim 107, wherein said CT injector is in line with said top drive and in an operational mode when said CT injector is above said first support surface.

109. The system of claim 108, wherein said CT injector is pivoted from a transport mode when above said second surface to said operational mode when above said first surface.

* * * * *